US005192093A

United States Patent [19]

Zeisky et al.

[11] Patent Number: 5,192,093

[45] Date of Patent: Mar. 9, 1993

[54] INDICIA CARD STORAGE DEVICE

[76] Inventors: Andre L. Zeisky, 55 W. 14th St., Apt. 4-D, New York, N.Y. 10011; Maurice Grunfeld, 37 Doral Ct., New City, N.Y. 10956

[21] Appl. No.: 872,680

[22] Filed: Apr. 20, 1992

[51] Int. Cl.[5] ..... B42D 19/00

[52] U.S. Cl. ..... 281/5; 281/15.1; 281/23; 40/376

[58] Field of Search ..... 281/2, 5, 15.1, 23; 283/34, 56; 40/376, 380, 383, 405, 156, 158.1

[56] References Cited

U.S. PATENT DOCUMENTS 4,583,763 4/1986 Shacklett, Jr. ..... 281/5
4,606,553 8/1986 Nickerson ..... 281/5
4,660,856 4/1987 Shacklett, Jr. ..... 281/5
5,104,146 4/1992 Schulz et al. ..... 281/15.1

*Primary Examiner*—Mark Rosenbaum
*Assistant Examiner*—Willmon Fridig, Jr.
*Attorney, Agent, or Firm*—Richard L. Miller

[57] ABSTRACT

An indicia card storage device is provided which consists of a pair of planar opposed covers, an elongated sheet having a plurality of foldable panels with indicia thereon and a foldable pull strip on a lower edge of the bottom panel. A mechanism is for securing an upper edge of the top panel of the elongated sheet between an upper edge of the covers, so that the panels can be folded up and stored between the covers, until the pull strip is unfolded and pulled out unfolding all the panels for viewing.

4 Claims, 1 Drawing Sheet

INDICIA CARD STORAGE DEVICE

BACKGROUND OF THE INVENTION

The instant invention relates generally to card holders and more specifically it relates to an indicia card storage device.

Numerous card holders have been provided in the prior art that are adapted to store and protect card, such as for business and advertising, therein and be carried on a person. For example, U.S. Pat. No. 4,436.053 to Zeisky is illustrative of such prior art. While these units may be suitable for the particular purpose to which they address, they would not be as suitable for the purposes of the present invention as heretofore described.

SUMMARY OF THE INVENTION

A primary object of the present invention is to provide an indicia card storage that will overcome the shortcomings of the prior art devices. Another object is to provide an indicia card storage device, so that an elongated sheet having a plurality of foldable panels where indicia thereon can be secured and stored between a pair of planar opposed covers.

An additional object is to provide an indicia card storage device in which the front cover can contain a pocket with a transparent window for receiving advertising material, a picture or a business card, so as to be viewed therefrom.

A further object is to provide an indicia card storage device that is simple and easy to use.

A still further object is to provide an indicia card storage device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
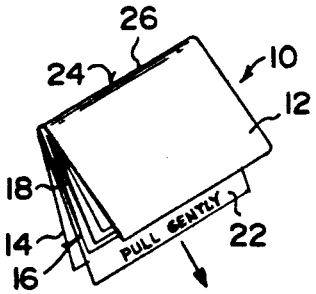
FIG. 1 is a diagrammatic perspective view of a first embodiment of the instant invention in a folded state.

Turning now descriptively to the drawings, in which similar reference characters denote similar elements throughout the several views, the Figures illustrate an indicia card storage device 10 which consists of a pair of planar opposed covers 12 and 14. An elongated sheet 16 has a plurality of foldable panels 18 with indicia 20 thereon and a foldable pull strip 22 on a lower edge of the bottom panel 18. A mechanism 24 is for securing an upper edge of the top panel 18 of the elongated sheet 16 between an upper edge of the covers 12 and 14. The panels 18 can be folded up and stored between the covers 12 and 14 until the pull strip 22 is unfolded and pulled out unfolding all the panels 18.

Figure 2:
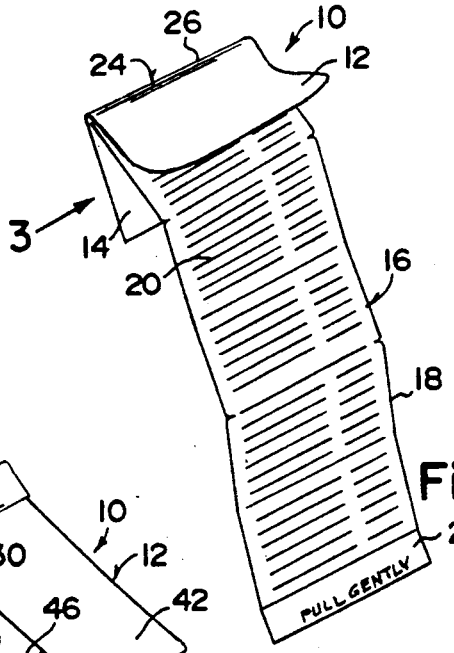
FIG. 2 is a diagrammatic perspective view of the first embodiment of the instant invention in an unfolded state.
Figure 3:
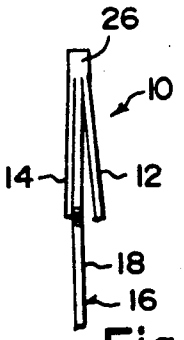
FIG. 3 is an enlarged edge elevational view with parts broken away and the paper thickness exaggerated taken in the direction of arrow 3 in FIG. 2.
Figure 4:
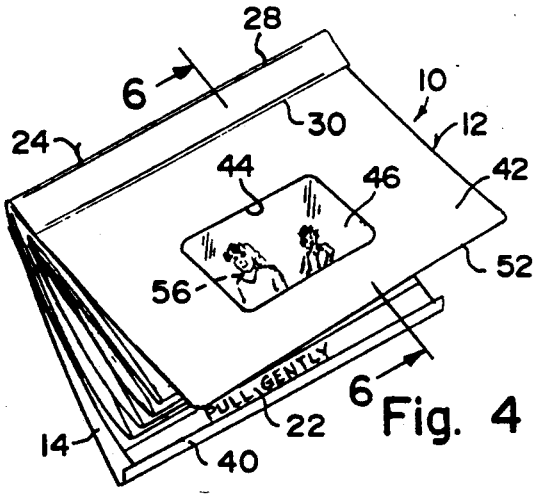
FIG. 4 is a diagrammatic perspective view of a second embodiment of the instant invention in a folded state.
Figure 7:
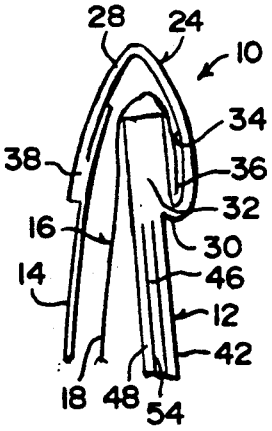
FIG. 7 is an enlarged edge elevational view with parts broken away, in the direction of arrow 7 in FIG. 5.
Figure 5:
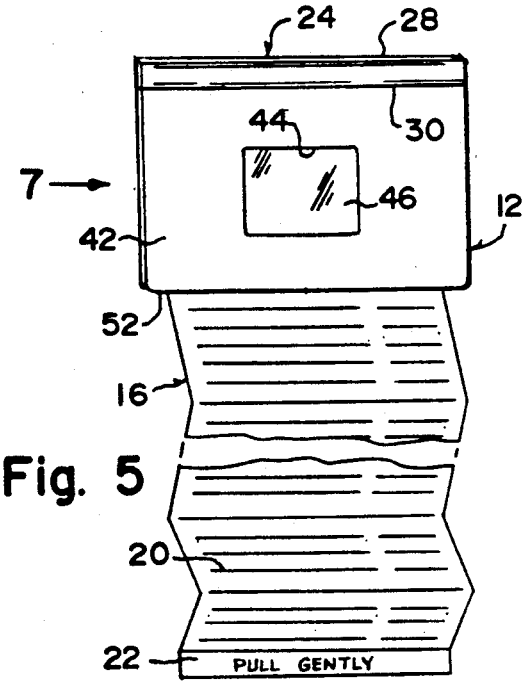
FIG. 5 is another diagrammatic perspective view of the second embodiment of the instant invention in an unfolded state.
Figure 6:
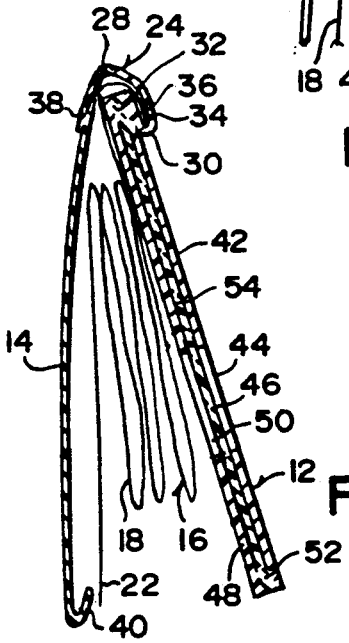
FIG. 6 is a cross sectional view taken along line 6—6 of FIG. 4.

The securing mechanism 24 in FIGS. 1, 2 and 3 is a heat seal 26 formed at the upper edge of the covers 12 and 14 and the upper edge of the top panel 18 of the elongated sheet 16.

The securing mechanism 24 in FIGS. 4, 5, 6 and 7 includes a folded planar spine 28 having an inwardly bent edge 30. A first heat seal 32 is formed at the upper edge of the front cover 12 and the inwardly bent edge 30 of the spine 28 to form a slot 34 therebetween. The upper edge 36 of the top panel 18 of the elongated sheet 16 can be folded over to be removably retained in the slot 34. A second heat seal 38 is formed at the upper edge of the rear cover 14 and the other edge of the spine 28.

The rear cover 14 can have an optional inwardly bent lower edge 40, so that the pull strip 22 on the lower edge of the bottom panel 18 of the elongated sheet 16 and the lower edge of the front cover 12 can both be tucked into the inwardly bent lower edge 40 on the rear cover 14. The front cover 12 has a first sheet 42 having an optional cutout window area 44, a second transparent sheet 46 and a third sheet 48 having an optional cutout window area 50. A heat seal 52 is formed at the lower edge of the first sheet 42, the second transparent sheet 46 and the third sheet 48, so as to provide a pocket 54 therebetween for receiving an indicia card 56 to be viewed therefrom.

The indicia card(s) 56 can be advertising material, a picture of a loved one or a business card and is inserted between sheets 44 and 46 and/or 46 and 48 facing in the desired directions so as to show through the appropriate optional cutout window areas 44 and/or 50. The indicia on each panel 18 of the elongated sheet 16 can be printed lines for the user to write an address and telephone list or any other type of printed data. The indicia card storage device 10 is generally fabricated out of a durable strong flexible plastic material, except for the elongate sheet which may be fabricated typically out of but not limited to plastic, cardboard or paper.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An indicia card storage device which comprises:

a) a pair of planar opposed covers;

b) an elongated sheet having a plurality of foldable panels with indicia thereon and a foldable pull strip on a lower edge of the bottom panel; and c) means for securing an upper edge of a top panel of said elongated sheet between an upper edge of said covers, so that the panels can be folded up and stored between said covers, wherein said securing means is a heat seal formed at the upper edge of said covers and the upper edge of the top panel of said elongated sheet, whereby a user may unfold the pull strip and pull out all the panels causing them to be unfolded and spread out for viewing.

2. An indicia card storage device which comprises:

a) a pair of planar opposed covers;

b) an elongated sheet having a plurality of foldable panels with indicia thereon and a foldable pull strip on a lower edge of the bottom panel; and c) means for securing an upper edge of a top panel of said elongated sheet between an upper edge of said covers, so that the panels can be folded up and stored between said covers, whereby a user may unfold the pull strip and pull out all the panels causing them to be unfolded and spread out for viewing, wherein said securing means includes:

i) a folded planar spine having an inwardly bent edge;

ii) a first heat seal formed at the upper edge of a front cover and the inwardly bent edge of said spine to form a slot therebetween, so that the upper edge of the top panel of said elongated sheet can be folded over to be removably retained in the slot; and iii) a second heat seal formed at the upper edge of a rear cover and the other edge of said spine.

3. An indicia card storage device as recited in claim 2, further including said rear cover having an inwardly bent lower edge, so that the pull strip on the lower edge of the bottom panel of said elongated sheet and the lower edge of said front cover can both be tucked into said inwardly bent lower edge on said rear cover.

4. An indicia card storage device as recited in claim 3, wherein said front cover includes:

a) a first sheet having a cutout window area;

b) a second transparent sheet;

c) a third sheet having a cutout window area; and d) a heat seal formed at the lower edge of said first sheet, said second transparent sheet and said third sheet, so as to provide two pockets therebetween for receiving an indicia card to be viewed therefrom.

* * * * *